US009257266B2

(12) United States Patent
Nakamura et al.

(10) Patent No.: US 9,257,266 B2
(45) Date of Patent: Feb. 9, 2016

(54) MICRO-CHANNEL PLATE, METHOD FOR MANUFACTURING MICRO-CHANNEL PLATE, AND IMAGE INTENSIFIER

(71) Applicant: HAMAMATSU PHOTONICS K.K., Hamamatsu-shi, Shizuoka (JP)

(72) Inventors: Kimitsugu Nakamura, Hamamatsu (JP); Yasumasa Hamana, Hamamatsu (JP); Takaaki Nagata, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 14/429,894

(22) PCT Filed: Jul. 11, 2013

(86) PCT No.: PCT/JP2013/069001
§ 371 (c)(1),
(2) Date: Mar. 20, 2015

(87) PCT Pub. No.: WO2014/050260
PCT Pub. Date: Apr. 3, 2014

(65) Prior Publication Data

US 2015/0279639 A1 Oct. 1, 2015

(30) Foreign Application Priority Data

Sep. 25, 2012 (JP) ..... 2012-211194

(51) Int. Cl.
*H01J 43/24* (2006.01)
*H01J 31/50* (2006.01)
(Continued)

(52) U.S. Cl.
CPC ..... *H01J 43/28* (2013.01); *H01J 9/125* (2013.01); *H01J 31/507* (2013.01); *H01J 43/246* (2013.01)

(58) Field of Classification Search
USPC ..... 427/58
See application file for complete search history.

(56) References Cited

U.S. PATENT DOCUMENTS 3,742,224 A 6/1973 Einstein
6,040,000 A * 3/2000 Floryan et al. ..... C23C 14/042 427/126.1

(Continued)

FOREIGN PATENT DOCUMENTS

JP S50-17960 A 2/1975
JP H03-116626 A 5/1991

(Continued)

OTHER PUBLICATIONS

English-language translation of International Preliminary Report on Patentability (IPRP) dated Apr. 9, 2015 that issued in WO Patent Application No. PCT/JP2013/069001.

*Primary Examiner* — Ashok Patel
(74) *Attorney, Agent, or Firm* — Drinker Biddle & Reath LLP

(57) ABSTRACT

In a micro-channel plate, an electron emission film and an ion barrier film formed on a substrate are integrally formed by the same film formation step. In this structure, the electron emission film and the ion barrier film are made as continuous and firm films and the ion barrier film can be made thinner. Since the ion barrier film is formed on the back side of an organic film, the organic film is exposed during removal of the organic film. This prevents the organic film from remaining and thus suppresses degradation of performance of the ion barrier film due to the residual organic film, so as to suppress ion feedback from the micro-channel plate and achieve a sufficient improvement in life characteristics of an image intensifier.

18 Claims, 14 Drawing Sheets

(51) Int. Cl.
*H01J 43/28* (2006.01)
*H01J 9/12* (2006.01)

(56) References Cited

U.S. PATENT DOCUMENTS 7,855,493 B2 12/2010 Sullivan et al.
8,227,965 B2 7/2012 Sullivan et al.
2009/0315443 A1* 12/2009 Sullivan et al. ..... H01J 43/04
313/103 CM

FOREIGN PATENT DOCUMENTS

JP H07-94139 A 4/1995
JP 2005-339844 A 12/2005

* cited by examiner

| | | | | | |
|---|---|---|---|---|---|
| ILLUMINANCE | 5400 μ lx | 540 μ lx | 54 lx | 540 μ lx | off |
| TIME | 5 SECONDS | 5 MINUTES | 3 SECONDS | 5 MINUTES AND 52 SECONDS | ONE MINUTE |

12 MINUTES/ONE CYCLE

MICRO-CHANNEL PLATE, METHOD FOR MANUFACTURING MICRO-CHANNEL PLATE, AND IMAGE INTENSIFIER

TECHNICAL FIELD

The present invention relates to a micro-channel plate, a method for manufacturing a micro-channel plate, and an image intensifier.

BACKGROUND ART

In the image intensifiers with the micro-channel plate used for multiplication of electrons, feedback of ions of Cs and/or residual gas from the inside of the micro-channel plate to a photocathode has been hitherto known as a factor to degrade life characteristics. For dealing with this problem, for example, in the case of the device described in Patent Literature 1, a film of metal such as Al (ion barrier film) is formed so as to cover the front surface of the micro-channel plate.

CITATION LIST

Patent Literature

Patent Literature 1: U.S. Pat. No. 3,742,224

SUMMARY OF INVENTION

Technical Problem

In the above-described conventional technique, prior to forming the ion barrier film on the surface of channels, an organic film is formed over the entire front surface of the micro-channel plate. Thereafter, the ion barrier film is formed on the organic film as underlying layer and, after completion of the formation of the ion barrier film, the organic film is removed by firing or the like. In this technique, however, since the organic film was situated in between the metal film and the channel surface, the organic film could remain on the front surface of the micro-channel plate. For this reason, the residual organic film could degrade the performance of the ion barrier film, raising a possibility of failure in achieving a sufficient improvement in life characteristics of the micro-channel plate. Furthermore, the ion barrier film is preferably as thin as possible, in order to secure secondary electron permeability, but if the conventional ion barrier film was simply made thinner, it would pose a problem in terms of mechanical strength.

The present invention has been accomplished in order to solve the above problem and it is an object of the present invention to provide a micro-channel plate, a method for manufacturing a micro-channel plate, and an image intensifier capable of achieving a sufficient improvement in life characteristics while suppressing the ion feedback.

Solution to Problem

In order to solve the above problem, a micro-channel plate according to the present invention comprises: a substrate having a front surface and a back surface; a plurality of channels penetrating from the front surface to the back surface of the substrate; an electron emission film formed on inner wall faces of the channels; and an ion barrier film formed so as to cover openings on the front surface side of the substrate in the channels, wherein the electron emission film and the ion barrier film are integrally formed by the same film formation step.

In this micro-channel plate, the electron emission film and the ion barrier film are integrally formed by the same film formation step. In this structure, the electron emission film and the ion barrier film are made as continuous and firm films and thus the ion barrier film can be made thinner than in the conventional structure. Since the ion barrier film is formed on the back side of the organic film (or on the opening side of the channels), the organic film can be kept exposed during removal of the organic film. This prevents the organic film from remaining on the front surface of the substrate of the micro-channel plate, which can suppress the performance degradation of the ion barrier film due to the residual organic film. Therefore, the ion feedback from the micro-channel plate can be suppressed well.

Preferably, the electron emission film and the ion barrier film are formed containing a metal oxide. Since the metal oxide has excellent chemical stability, use of the metal oxide leads to suppression of temporal change of the electron emission film and the ion barrier film.

Preferably, the electron emission film and the ion barrier film are deposited by an atomic layer deposition method. When the atomic layer deposition method is adopted, the electron emission film and the ion barrier film can be made more definitely as firm and fine films.

Preferably, a metal film formed so as to cover the front surface of the substrate is formed on the ion barrier film. In this case, the metal film can also serve as an electrode on the channel IN side (input electrode). The metal film can supply electrons, which can prevent the ion barrier film from becoming electrically charged.

Preferably, a resistive film is formed inside with respect to the electron emission film on the inner wall faces of the channels. In this case, when a voltage is applied between the channel IN side and OUT side, a potential gradient is established by the resistive film, enabling electron multiplication.

Preferably, the resistive film is integrally formed by the same film formation step as the electron emission film and the ion barrier film are. This facilitates the formation of the resistive film.

Preferably, an input electrode is formed at an end on the front surface side of the substrate in the channels and an output electrode is formed at an end on the back surface side of the substrate in the channels. In this case, a sufficient region is secured as a region functioning as the electron emission film.

Preferably, the output electrode is formed outside with respect to the electron emission film. In this case, emission angles of secondary electrons from the electron emission film are limited, which can enhance the resolution.

A method for manufacturing a micro-channel plate according to the present invention, comprises: a substrate preparation step of preparing a substrate in which a plurality of channels are formed so as to penetrate from a front surface to a back surface; an organic film formation step of forming an organic film so as to cover the front surface of the substrate; a functional film formation step of, by use of an atomic layer deposition method, forming an electron emission film on inner wall faces of, the channels and, at the same time, forming an ion barrier film covering openings on the front surface side of the substrate in the channels so as to overlap the organic film, integrally with the electron emission film; and an organic film removal step of removing the organic film from the front surface of the substrate, after formation of the electron emission film and the ion barrier film.

In this method for manufacturing the micro-channel plate, the electron emission film and the ion barrier film are integrally formed by the atomic layer deposition method. By this, the electron emission film and the ion barrier film are made as continuous and firm films and thus the ion barrier film can be made thinner than by the conventional method. Since the ion barrier film is formed inside with respect to the organic film (or on the opening side of the channels), the organic film can be kept exposed during removal of the organic film. This prevents the organic film from remaining on the front surface of the substrate of the micro-channel plate, which can suppress the performance degradation of the ion barrier film due to the residual organic film. Therefore, the ion feedback from the micro-channel plate can be suppressed well.

Preferably, the method further comprises a metal film formation step of forming a metal film so as to cover a face of the ion barrier film on the far side from the substrate, after the organic film removal step. In this case, the metal film can also serve as an electrode on the channel IN side (input electrode). The metal film can supply electrons, which can prevent the ion barrier film from becoming electrically charged.

Another method for manufacturing a micro-channel plate according to the present invention, comprises: a substrate preparation step of preparing a substrate in which a plurality of channels are formed so as to penetrate from a front surface to a back surface; an organic film formation step of forming an organic film so as to cover the front surface of the substrate; a metal film formation step of forming a metal film so as to cover a face of the organic film on the far side from the substrate; an organic film removal step of removing the organic film from the front surface of the substrate, after formation of the metal film; and a functional film formation step of, by use of an atomic layer deposition method, forming an electron emission film on inner wall faces of the channels and, at the same time, forming an ion barrier film covering openings on the front surface side of the substrate in the channels so as to overlap the metal film, integrally with the electron emission film, after the organic film removal step.

In this method for manufacturing the micro-channel plate, the electron emission film and the ion barrier film are integrally formed by the atomic layer deposition method. By this, the electron emission film and the ion barrier film are made as continuous and firm films and thus the ion barrier film can be made thinner than by the conventional method. Since the organic film is removed from the front surface of the substrate after the formation of the metal film, the organic film is prevented from remaining on the front surface of the substrate of the micro-channel plate, which can suppress the performance degradation of the ion barrier film due to the residual organic film. Therefore, the ion feedback from the micro-channel plate can be suppressed well.

Preferably, the method further comprises a resistive film formation step of forming a resistive film on the inner wall faces of the channels, prior to the organic film formation step. With this resistive film, when a voltage is applied between the channel IN side and OUT side, a potential gradient is established by the resistive film, enabling electron multiplication.

Preferably, in the functional film formation step, a resistive film is formed integrally with the electron emission film and the ion barrier film, between the inner wall faces of the channels and the electron emission film. In this case, this facilitates formation of the resistive film Preferably, the method further comprises an output electrode formation step of forming an output electrode at an end on the back surface side of the substrate in the channels, after the functional film formation step. In this case, emission angles of secondary electrons from the electron emission film are limited, which can enhance the resolution.

An image intensifier according to the present invention comprises: a photocathode for converting incident light into photoelectrons; the aforementioned micro-channel plate for multiplying the photoelectrons emitted from the photocathode; and an electron incidence surface for receiving electrons multiplied by the micro-channel plate.

This image intensifier uses the foregoing micro-channel plate to suppress the degradation of the photocathode due to the ion feedback, which can achieve a sufficient improvement in life characteristics.

Advantageous Effect of Invention

According to the present invention, the ion feedback from the micro-channel plate is suppressed well, so as to achieve the sufficient improvement in life characteristics of the image intensifier.

DESCRIPTION OF EMBODIMENTS

Preferred embodiments of the micro-channel plate, the method for manufacturing the micro-channel plate, and the image intensifier according to the present invention will be described below in detail with reference to the drawings.

Figure 1:
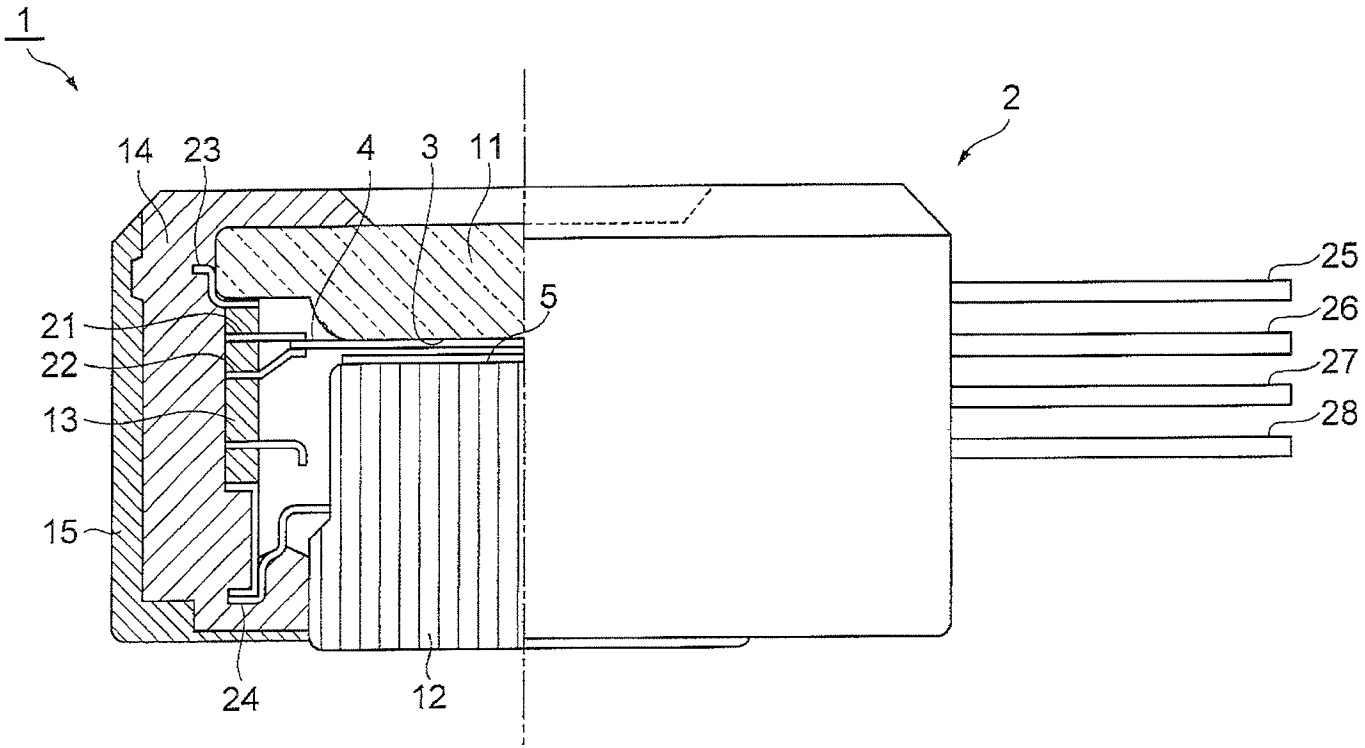
FIG. 1 is a partial cross-sectional view showing an image intensifier according to an embodiment of the present invention.
Figure 2:
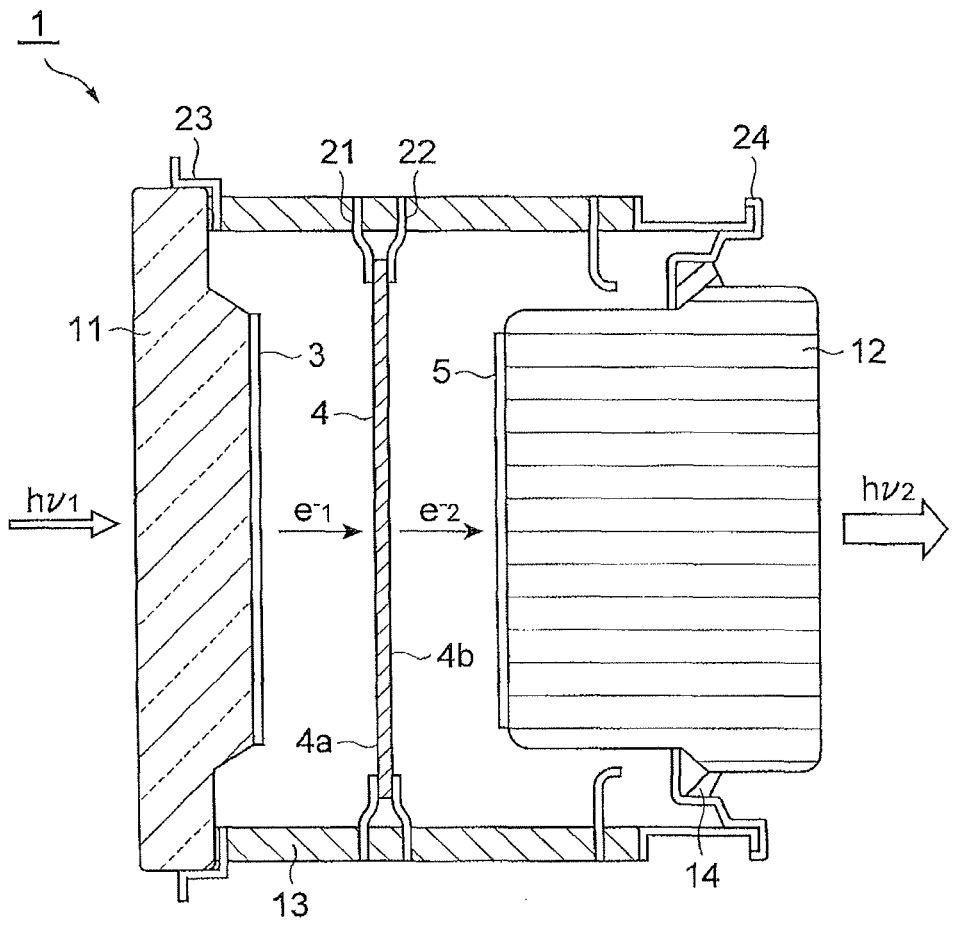
FIG. 2 is a cross-sectional view showing a simplified configuration of a major part of the image intensifier shown in FIG. 1.

FIG. 1 is a partial cross-sectional view showing an image intensifier according to an embodiment of the present invention. FIG. 2 is a cross-sectional view showing a simplified configuration of a major part of the image intensifier shown in FIG. 1. The image intensifier 1 shown in FIGS. 1 and 2 is an image intensifier in which a photocathode 3, a micro-channel plate 4, and a phosphor screen 5 are arranged in proximity inside a housing 2.

The interior of the image intensifier 1 is held in a high vacuum state while the two ends of the housing 2 of a substantially hollow columnar shape are hermetically sealed by an entrance window 11 and an exit window 12 of a substantially circular disk shape. The housing 2 is composed, for example, of a ceramic side tube 13 of a substantially hollow cylindrical shape, a silicone rubber molded member 14 of a substantially hollow columnar shape covering the side of the side tube 13, and a ceramic case member 15 of a substantially hollow cylindrical shape covering the side and bottom of the molded member 14.

For example, two through holes are formed at the two ends of the molded member 14. One end of the case member 15 is open, while a through hole with the same periphery as one through hole of the molded member 14 is formed at the other end of the case member 15. On the one end side of the molded member 14, the entrance window 11 of glass is joined to the surface of the surrounding region around the one through hole of the molded member 14. The photocathode 3 of a thin film shape is provided in a substantially central region of the vacuum-side surface of the entrance window 11. The entrance window 11 is, for example, a platelike member comprised of silica glass and the photoelectron surface 3 is formed by evaporating an alkali metal such as K or Na on the platelike member.

On the other hand, on the other end side of the molded member 14, the exit window 12 is fit in the other through hole of the molded member 14. The phosphor screen (electron incidence surface) 5 of a thin film shape is provided in a substantially central region of the vacuum-side surface of the exit window 12. The exit window 12 is, for example, a fiber plate composed of a large number of optical fibers bundled in a plate shape. The optical fibers of the fiber plate are held in a state in which their optical axes are perpendicular to the photocathode 3 and in which their vacuum-side end faces are aligned so as to be flush with each other. The phosphor screen 5 is formed by applying a fluorescent material such as (ZnCd) S:Ag onto the vacuum-side surface of this fiber plate. A light image emitted from the phosphor screen 5 passes through the fiber plate and then is taken generally by an imaging device such as a CCD camera. In this example, electrons multiplied by the micro-channel plate are converted into a light image by the fluorescent material of electron incidence surface and the light image is taken finally by the CCD camera; however, it is also possible to implement the imaging by making use of an electron bombardment type solid-state image sensor (e.g., EBCCD) as electron incidence surface.

A metal back layer and a low-electron-reflectance layer are successively stacked on the vacuum-side surface of the phosphor screen 5. The metal back layer is formed, for example, by evaporation of Al and has a relatively high reflectance for light having passed through the micro-channel plate 4 and a relatively high transmittance for photoelectrons from the micro-channel plate 4. The low-electron-reflectance layer is formed, for example, by evaporation of C, Be, or the like and has a relatively low reflectance for photoelectrons from the micro-channel plate 4.

The micro-channel plate 4 of a substantially circular disk shape is located between the photoelectron surface 3 and the phosphor screen 5. The micro-channel plate 4 is supported by inner edges of mount members 21, 22 fixed to the inner wall of the side tube 13 and is kept opposed with a predetermined space to the photoelectron surface 3 and to the phosphor screen 5. The micro-channel plate 4 functions as a multiplication portion to multiply electrons, which multiplies photoelectrons generated in the photocathode 3 and thereafter outputs resultant electrons toward the phosphor screen 5.

In a peripheral region of the vacuum-side surface of the entrance window 11, a metal wiring layer (not shown) is electrically connected to the photocathode 3. For the connection between this wiring layer and the photoelectron surface 3, a mount member 23 sandwiched between the side tube 13 and the entrance window 11 is fixed so as to extend into the molded member 14. In a peripheral region of the vacuum-side surface of the exit window 12, another wiring layer of metal (not shown) is electrically connected to the phosphor screen 5. For the connection between this wiring layer and the phosphor screen 5, a mount member 24 sandwiched between the side tube 13 and the molded member 14 is fixed so as to extend into the molded member 14.

Connected to ends of the mount members 21 to 24 are one ends of lead wires 25 to 28 comprised, for example, of Kovar metal. The other ends of the lead wires 25 to 28 project hermetically through the molded member 14 and the case member 15 to the outside to be electrically connected to an external voltage source (not shown). This allows a predetermined voltage from the external voltage source to be applied to the photocathode 3, the micro-channel plate 4, and the phosphor screen 5. A potential difference, e.g., approximately 200 V is set between the photoelectron surface 3 and an input surface 4*a* (cf.FIG. 2) of the micro-channel plate 4 and a potential difference, e.g., approximately 500 V to 900 V is variably set between the input surface 4*a* and an output surface 4*b* (cf. FIG. 2) of the micro-channel plate 4. Furthermore, a potential difference, e.g., approximately 6 kV is set between the output surface 4*b* of the micro-channel plate 4 and the phosphor screen 5.

Figure 3:
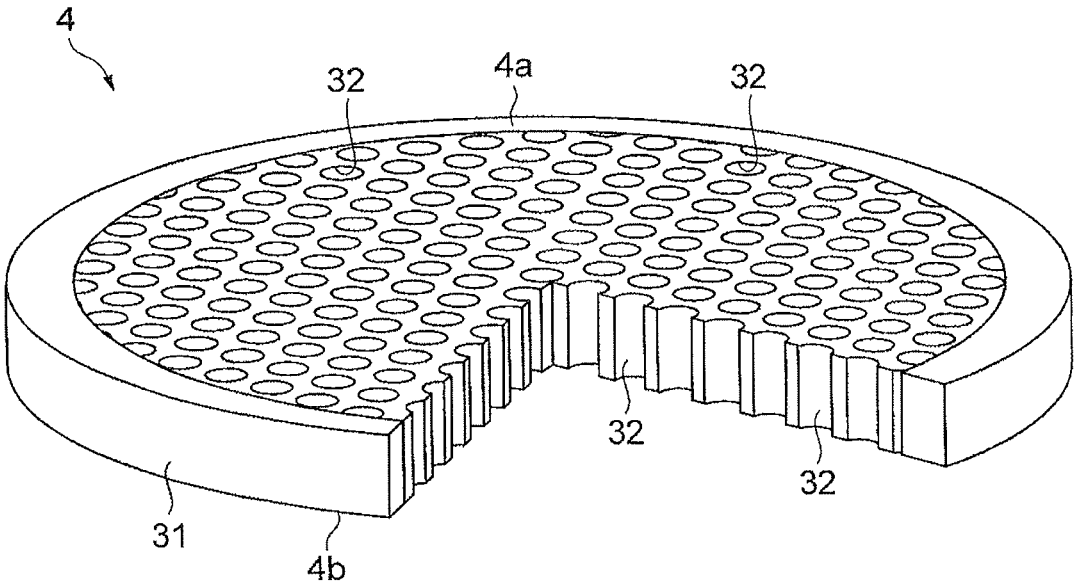
FIG. 3 is a perspective view showing an example of a micro-channel plate built in the image intensifier shown in FIG. 1.
Figure 4:
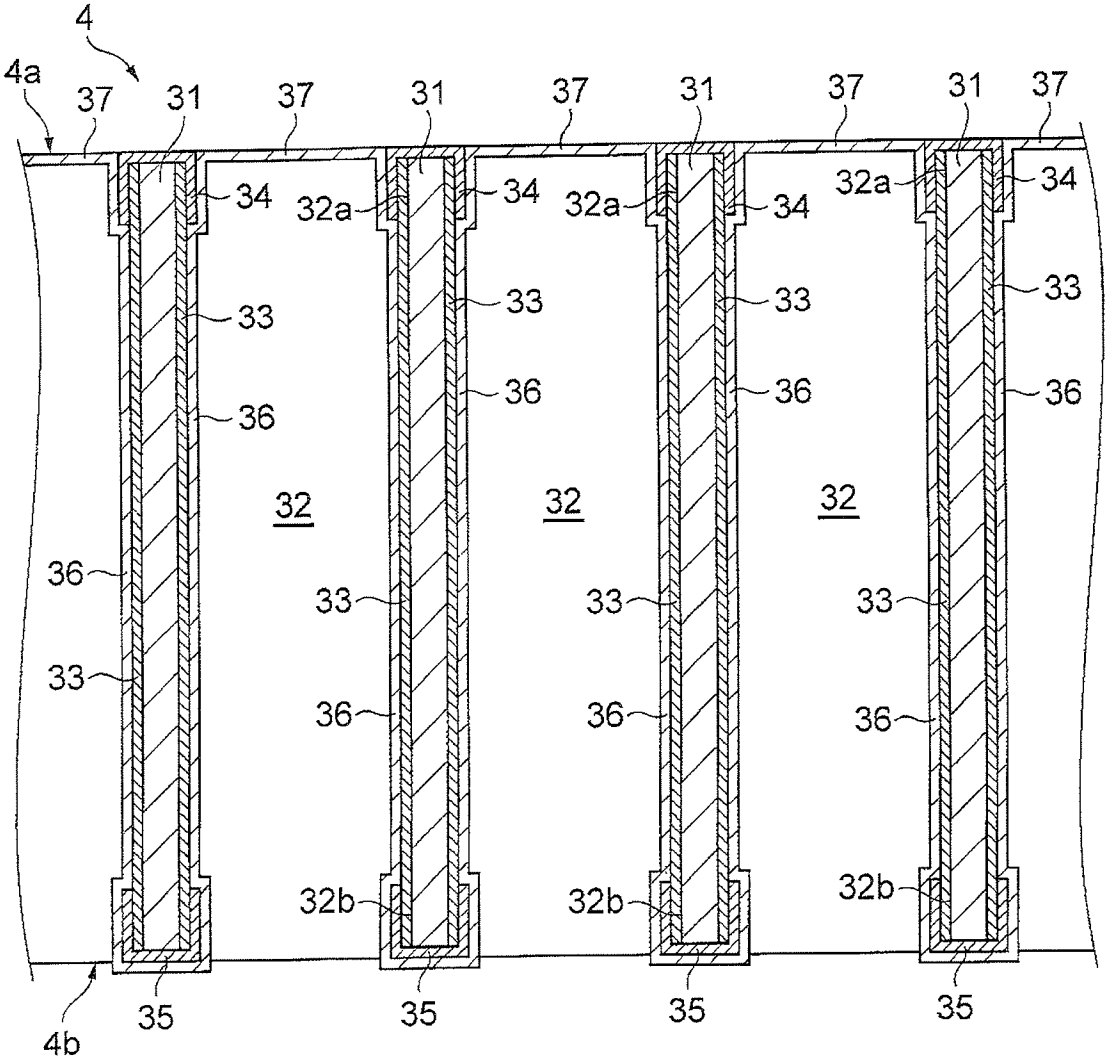
FIG. 4 is a cross-sectional view showing a film configuration of the micro-channel plate shown in FIG. 3.

Next, the above-described micro-channel plate 4 will be described in further detail. FIG. 3 is a perspective view showing an example of the micro-channel plate. FIG. 4 is a cross-sectional view showing a film configuration thereof.

As shown in FIG. 3, the micro-channel plate 4 has a substrate 31 of a circular disk shape having the input surface (front surface) 4*a* and the output surface (back surface) 4*b*. The substrate 31 is made, for example, of an insulating material such as lead glass or aluminum oxide obtained by anodizing. A plurality of channels 32 of a circular sectional shape penetrating from the input surface 4*a* side to the output surface 4*b* side are formed in the substrate 31. The channels 32 are arranged in a matrix on the plan view so that the center-center distance between adjacent channels 32 is, for example, from several μm to several ten μm. The substrate 31, as shown in FIG. 4, has a resistive film 33, an input electrode 34, an output electrode 35, an electron emission film 36, and an ion barrier film 37 formed as functional films.

The resistive film 33 is provided over the entire inner wall faces of the channels 32 and inside with respect to the electron emission film 36. The thickness of the resistive film 33 is, for example, approximately from 100 Å to 10000 Å. This resistive film 33 is formed as follows, for example, when the substrate 31 is made of lead glass: the substrate 31 is set in a vacuum furnace, and hot hydrogen gas is made to flow into the furnace to reduce the surface of lead glass. The resistance of the resistive film 33 can be adjusted to a desired value by controlling an ambient temperature in the vacuum furnace, a concentration of hydrogen gas, a reduction time, and so on. The resistive film 33 can be formed by a below-described atomic layer deposition method. When the atomic layer deposition method is adopted, the resistive film 33 can be formed, for example, by depositing a plurality of $Al_2O_3$ layers and ZnO layers. The preferred thickness of the resistive layer 33 in this case is from 20 Å to 400 Å.

The input electrode 34 and the output electrode 35 are provided at the end on the input surface 4*a* side and at the end on the output surface 4*b* side, respectively, in the channels 32. The input electrode 34 and the output electrode 35 are formed, for example, by evaporation of ITO films comprised of $In_2O_3$ and $SnO_2$, NESA films, Nichrome films, Inconel (registered trademark) films, or the like. By use of the evaporation, the input electrode 34 is formed over a region except openings 32*a* of the channels 32 in the input surface 4*a* and over the ends on the input surface 4*a* side in the inner wall faces of the channels 32, and the output electrode 35 is formed over a region except openings 32*b* of the channels 32 in the output surface 4*b* and over the ends on the output surface 4*b* side in the inner wall faces of the channels 32. The thicknesses of the input electrode 34 and the output electrode 35 are, for example, approximately 1000 Å.

The electron emission film 36 is provided over the entire inner wall faces of the channels 32 so as to cover the resistive film 33, the input electrode 34, and the output electrode 35. The ion barrier film 37 is formed so as to cover the openings 32*a* on the input surface 4*a* side in the channels 32. The thicknesses of the electron emission film 36 and the ion barrier film 37 are, for example, approximately from 10 Å to 200 Å. These electron emission film 36 and ion barrier film 37 are integrally formed by the same step, for example, by use of the atomic layer deposition method (ALD: Atomic Layer Deposition).

The atomic layer deposition method is a technique of repetitively carrying out an adsorption step of molecules of a compound, a film formation step by reaction, and a purge step of removing excess molecules, thereby to stack atomic layers one by one, so as to obtain a thin film. From the viewpoint of achieving chemical stability, a metal oxide is used as a material for making up the electron emission film 36 and the ion barrier film 37. Examples of such metal oxide include $Al_2O_3$, MgO, BeO, CaO, SrO, BaO, $SiO_2$, $TiO_2$, RuO, ZrO, NiO, CuO, GaO, ZnO, and so on.

Next, a method for manufacturing the micro-channel plate 4 will be described.

Figure 5:
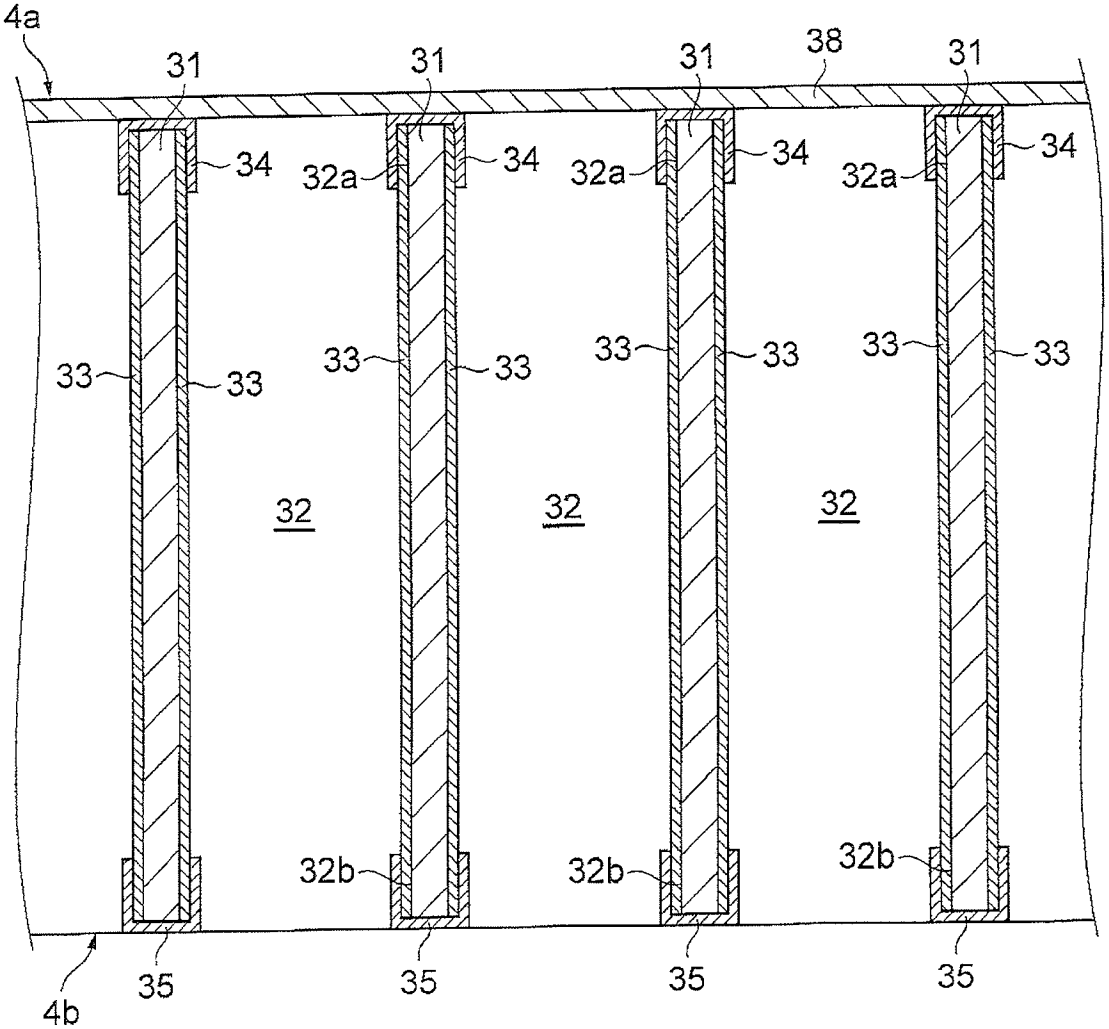
FIG. 5 is a cross-sectional view showing a manufacturing step of the micro-channel plate shown in FIG. 3.

For manufacturing the micro-channel plate 4 having the configuration as described above, the resistive film 33, input electrode 34, and output electrode 35 each are first formed on the substrate 31. Then, as shown in FIG. 5, an organic film 38 is formed so as to cover the input surface 4*a*. This organic film 38 is, for example, a nitrocellulose film. The thickness of the organic film 38 is preferably from 200 Å to 400 Å, for example. An applicable method for forming the organic film can be a known method (e.g., cf. Japanese Patent Publication No. Sho53-35433, page 4, left column, line 2 to page 4, right column, line 8).

Figure 6:
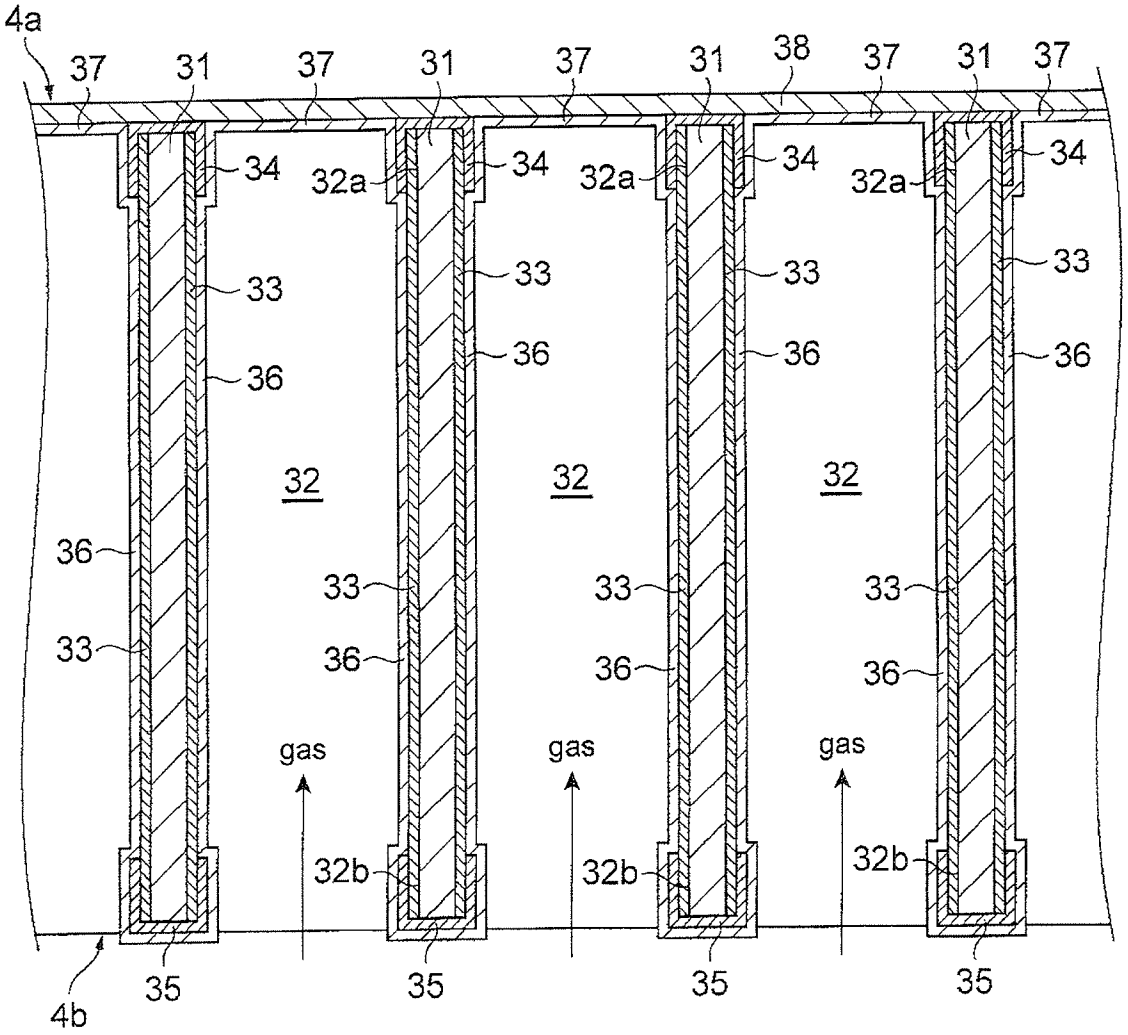
FIG. 6 is a cross-sectional view showing a step subsequent to FIG. 5.

After formation of the organic film 38, as shown in FIG. 6, the electron emission film 36 and the ion barrier film 37 are formed by the same step by use of the atomic layer deposition method. In this step, a gas containing the metal oxide as the material for making up the electron emission film 36 and the ion barrier film 37 is made to flow into the channels 32 from the output surface 4*b* side. By doing so, while the organic film 38 serves as a lid for closing the input surface 4*a* side of the channels 32, the electron emission film 36 is formed on the inner wall faces of the channels 32 and, at the same time, the ion barrier film 37 is formed so as to cover the openings 32*a* on the input surface 4*a* side of the channels 32 as overlapping the back surface side of the organic film 38.

For example, when the electron emission film 36 and the ion barrier film 37 are formed using $Al_2O_3$, a reactant gas to be used can be, for example, trimethyl aluminum. In this case, the film formation process includes an adsorption step of $H_2O$, a purge step of $H_2O$, an adsorption step of trimethyl aluminum, and a purge step of trimethyl aluminum. These steps are repeated until achievement of the desired thickness (e.g., 10 Å to 100 Å) of the electron emission film 36 and the ion barrier film 37, thereby forming the electron emission film 36 and ion barrier film 37.

After formation of the electron emission film 36 and ion barrier film 37, heating is carried out for a predetermined duration to remove the organic film 38 from the input surface 4*a*. This process results in obtaining the micro-channel plate 4.

In the image intensifier 1, as described above, the electron emission film 36 and the ion barrier film 37 formed on the substrate 31 of the micro-channel plate 4 are integrally formed by the same film formation step by means of the atomic layer deposition method. In this structure, the electron emission film 36 and ion barrier film 37 are made as continuous and firm films and, therefore, the ion barrier film 37 can be made thinner than in the conventional structure. Since the ion barrier film 37 is formed on the back side of the organic film (or on the opening 32*a* side of the channels 32), the organic film 38 can be kept exposed during removal of the organic film 38. This prevents the organic film 38 from remaining on the input surface 4*a* of the micro-channel plate 4, which can suppress the degradation of performance of the ion barrier film 37 due to the residual organic film serving as a gas source. Therefore, the ion feedback from the micro-channel plate 4 is prevented well, whereby a sufficient improvement can be achieved in life characteristics of the image intensifier 1.

In the micro-channel plate 4, the electron emission film 36 and the ion barrier film 37 are formed containing the metal oxide. Since the metal oxide has excellent chemical stability, use of the metal oxide leads to suppression of temporal change of the electron emission film 36 and the ion barrier film 37.

The input electrode 34 and the output electrode 35 are formed inside with respect to the electron emission film 36 at the end on the input surface 4*a* side and at the end on the output surface 4*b* side, respectively, in the channels 32. When the input electrode 34 and the output electrode 35 are formed inside with respect to the electron emission film 36 in this manner, a sufficient region can be secured as a region where the electron emission film 36 is exposed in the channels 32.

Figure 7:
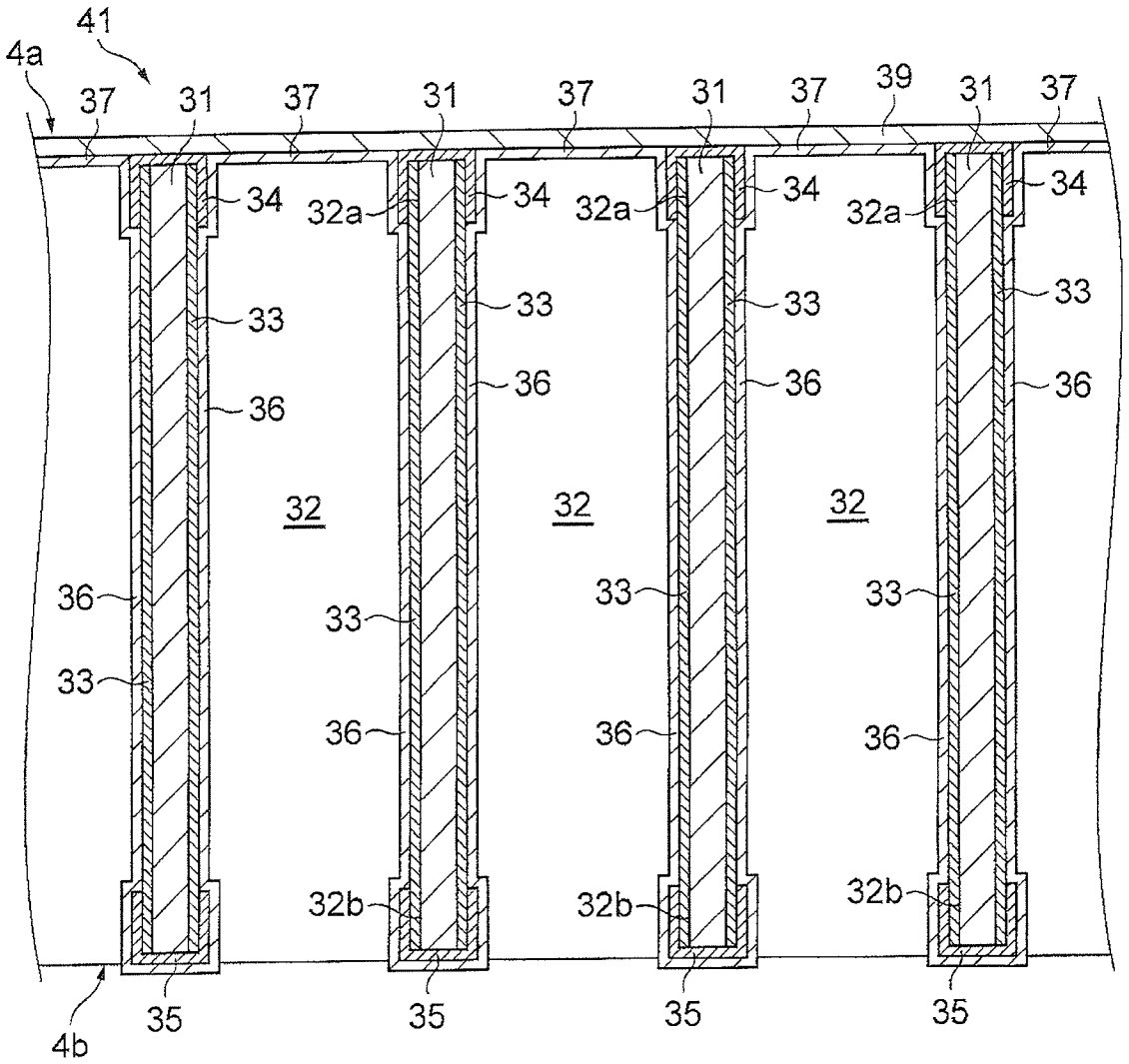
FIG. 7 is a cross-sectional view showing a film configuration of a micro-channel plate according to a modification example.

The present invention does not have to be limited to the above embodiment, but the present invention can be modified in many ways. FIG. 7 is a cross-sectional view showing a film configuration of a micro-channel plate according to a modification example. The micro-channel plate 41 shown in the same drawing is different from the above embodiment in that a metal film 39 is provided on the ion barrier film 37 so as to cover the input surface 4*a*. The metal film 39 is formed, for example, by evaporation of Al and the thickness of the metal film 39 is, for example, approximately from 40 Å to 120 Å.

Figure 8:
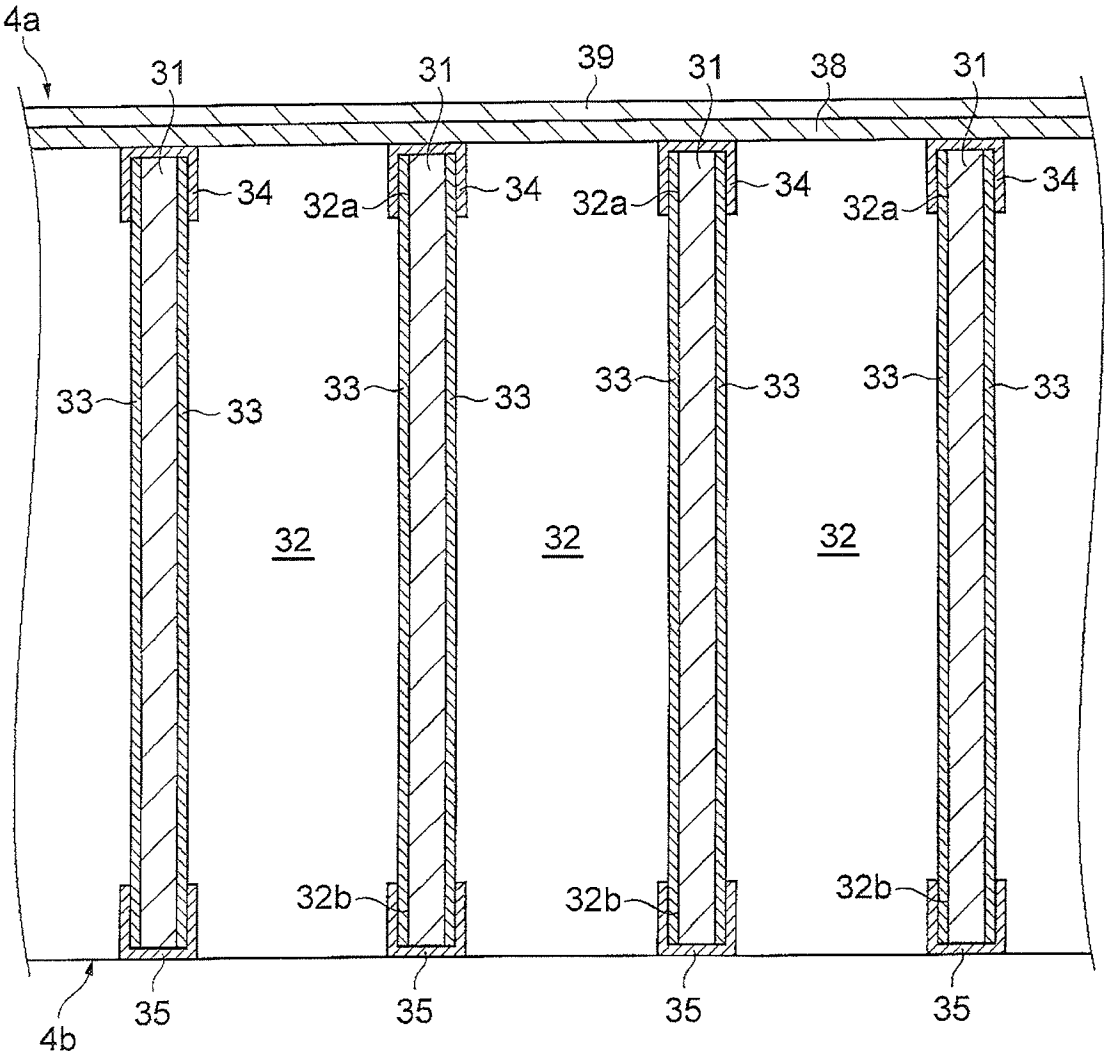
FIG. 8 is a cross-sectional view showing a manufacturing step of the micro-channel plate shown in FIG. 7.

For manufacturing the micro-channel plate 41 having this configuration, the resistive film 33, input electrode 34, and output electrode 35 each are first formed on the substrate 31. Next, as shown in FIG. 8, the organic film 38 such as the nitrocellulose film is formed so as to cover the input surface 4*a* and then the metal film 39 is formed so as to cover the front surface of the organic film 38. After formation of the metal film 39, heating is carried out for a predetermined duration to remove the organic film 38 from the input surface 4*a*.

Figure 9:
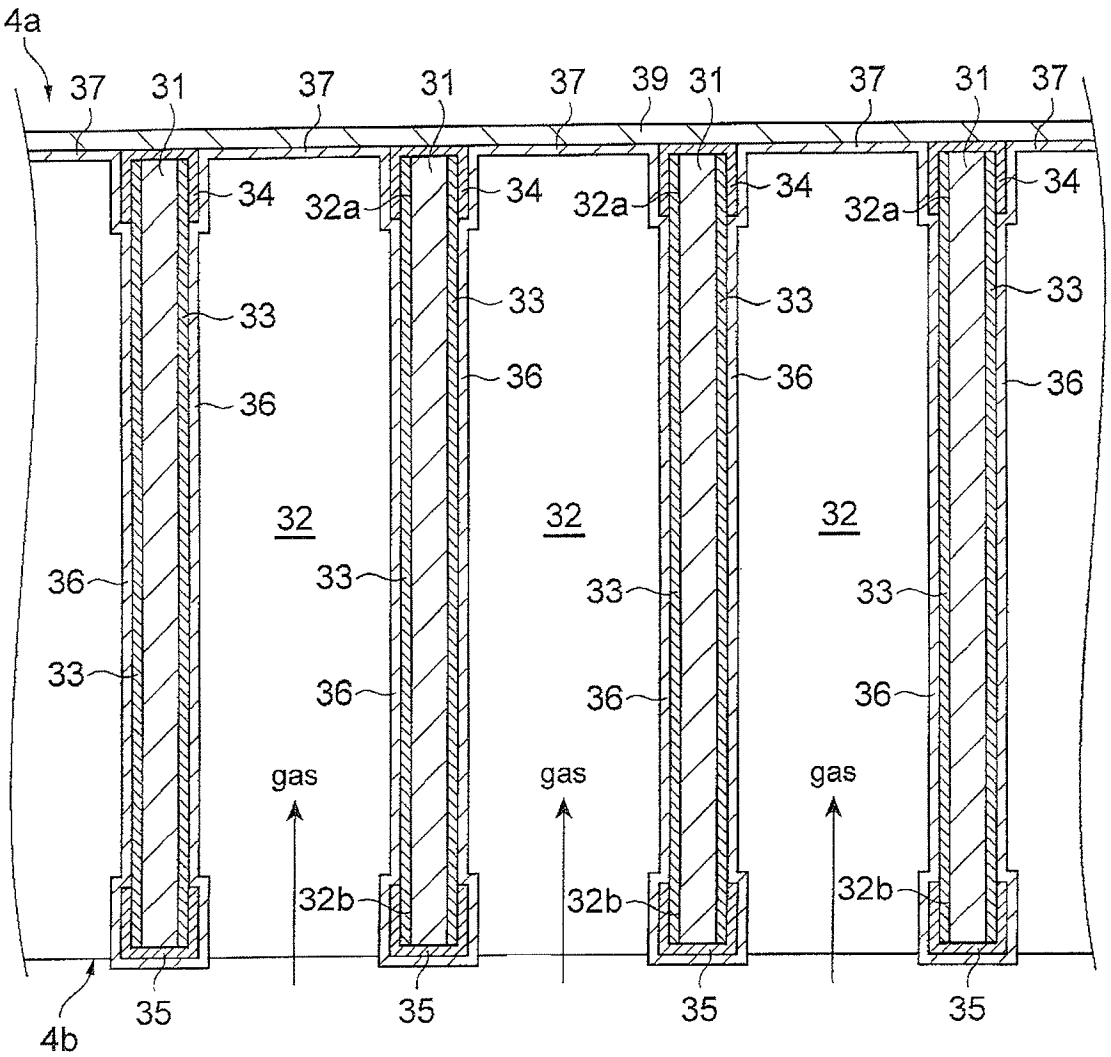
FIG. 9 is a cross-sectional view showing a step subsequent to FIG. 8.

After removal of the organic film 38, as shown in FIG. 9, the electron emission film 36 and the ion barrier film 37 are formed by the same step by use of the atomic layer deposition method. In this step, a gas containing the metal oxide as the material for making up the electron emission film 36 and the ion barrier film 37 is made to flow into the channels 32 from the output surface 4*b* side, as in the case shown in FIG. 6. By this step, the electron emission film 36 is formed on the inner wall faces of the channels 32 and, at the same time, the ion barrier film 37 is formed so as to cover the openings 32*a* on the input surface 4*a* side of the channels 32 as overlapping the back surface side of the metal film 39. Through the above, the metal film 39 is located on the ion barrier film 37.

This form also achieves the same effect as the above embodiment. In addition, the metal film 39 on the ion barrier film 37 can supply electrons, which can prevent the ion barrier film 37 from becoming electrically charged. Furthermore, since the metal film 39 on the ion barrier film 37 can serve as an electrode on the channel IN side (input electrode), it also becomes possible to omit formation of the input electrode 34 in FIG. 9. The method for forming the metal film 39 is not limited to the above method. For example, the electron emission film 36 and the ion barrier film 37 are first formed, the organic film 38 is then removed, and thereafter the metal film 39 may be deposited on the ion barrier film 37 by evaporation.

Figure 10:
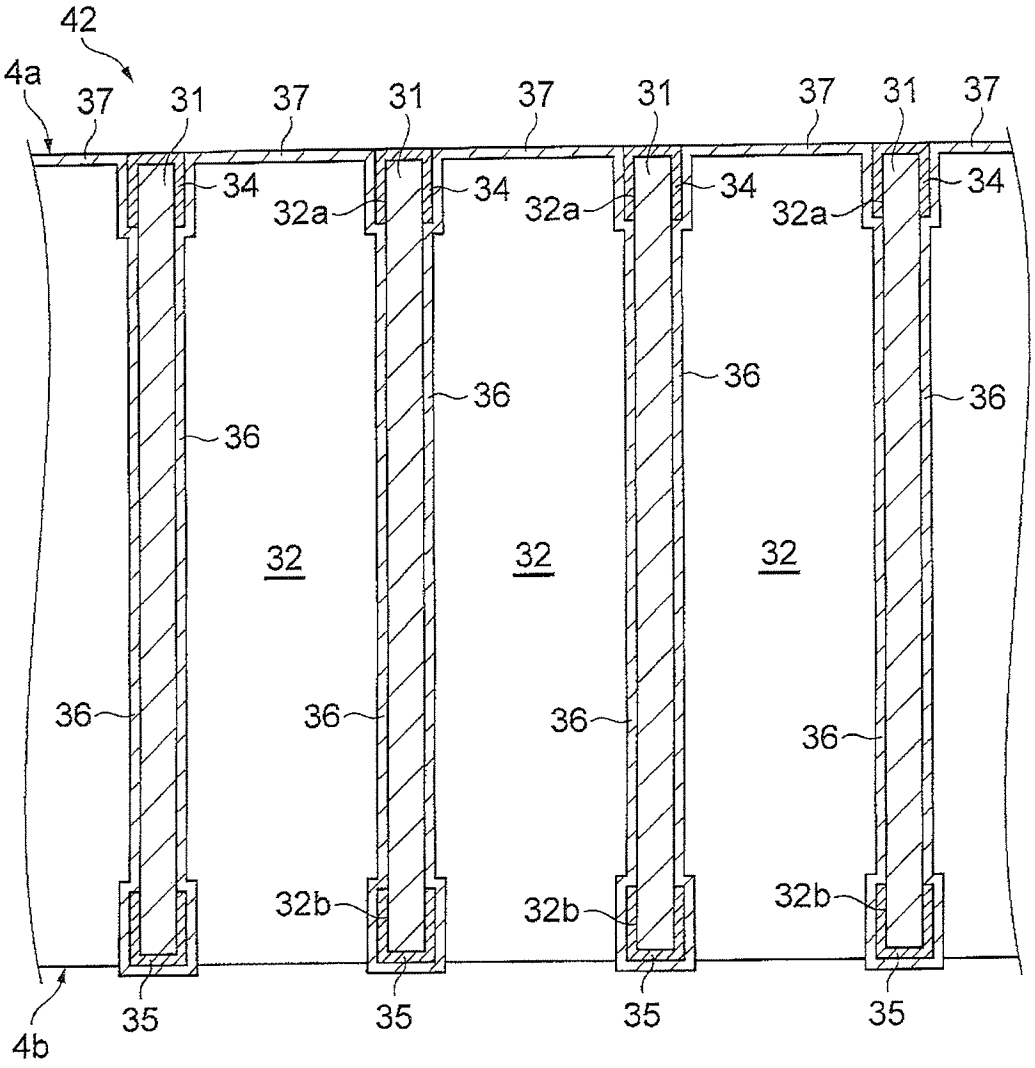
FIG. 10 is a cross-sectional view showing a film configuration of a micro-channel plate according to another modification example.

FIG. 10 is a cross-sectional view showing a film configuration of a micro-channel plate according to another modification example of the present invention. The micro-channel plate 42 shown in the same drawing is different from the above embodiment wherein the substrate 31 is formed of the insulating material, in that the substrate 31 is formed of a semiconductor material such as Si. In this form, there is no need for providing the resistive film 33 on the inner wall faces of the channels 32, and the input electrode 34, output electrode 35, and electron emission film 36 are formed directly on the inner wall faces of the channels 32. This form also achieves the same effect as the above embodiment. In addition, product cost can be curtailed because the manufacturing step of the resistive film 33 is omitted.

Figure 11:
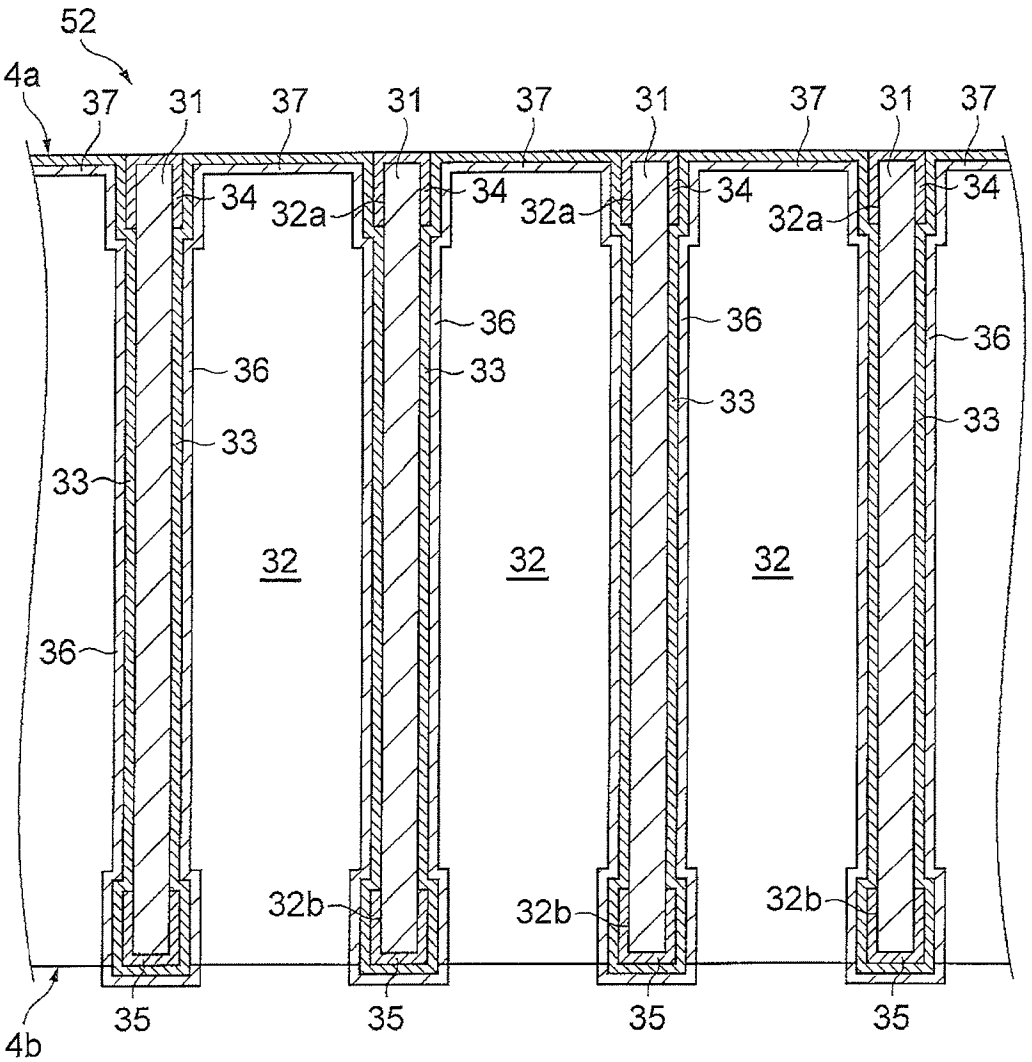
FIG. 11 is a cross-sectional view showing a film configuration of a micro-channel plate according to still another modification example.

Furthermore, the above embodiment described the case where the electron emission film 36 and the ion barrier film 37 were integrally formed by the same film formation step, but another available method may be configured to further integrally form the resistive film 33 as well by the same film formation step. In this case, as shown in FIG. 11, by use of the atomic layer deposition method, for example, a plurality of layered $Al_2O_3$ and ZnO films are deposited to a predetermined thickness to form the resistive film 33 and thereafter only $Al_2O_3$ is subsequently further deposited to a predetermined thickness to form the electron emission film 36 and the ion barrier film 37. In the micro-channel plate 52 manufactured in this manner, the resistive film 33 can supply electrons, which can prevent the ion barrier film 37 from becoming electrically charged. In view of the secondary electron permeability, the total thickness of the resistive film 33, electron emission film 36, and ion barrier film 37 is preferably not more than 400 Å.

Figure 12:
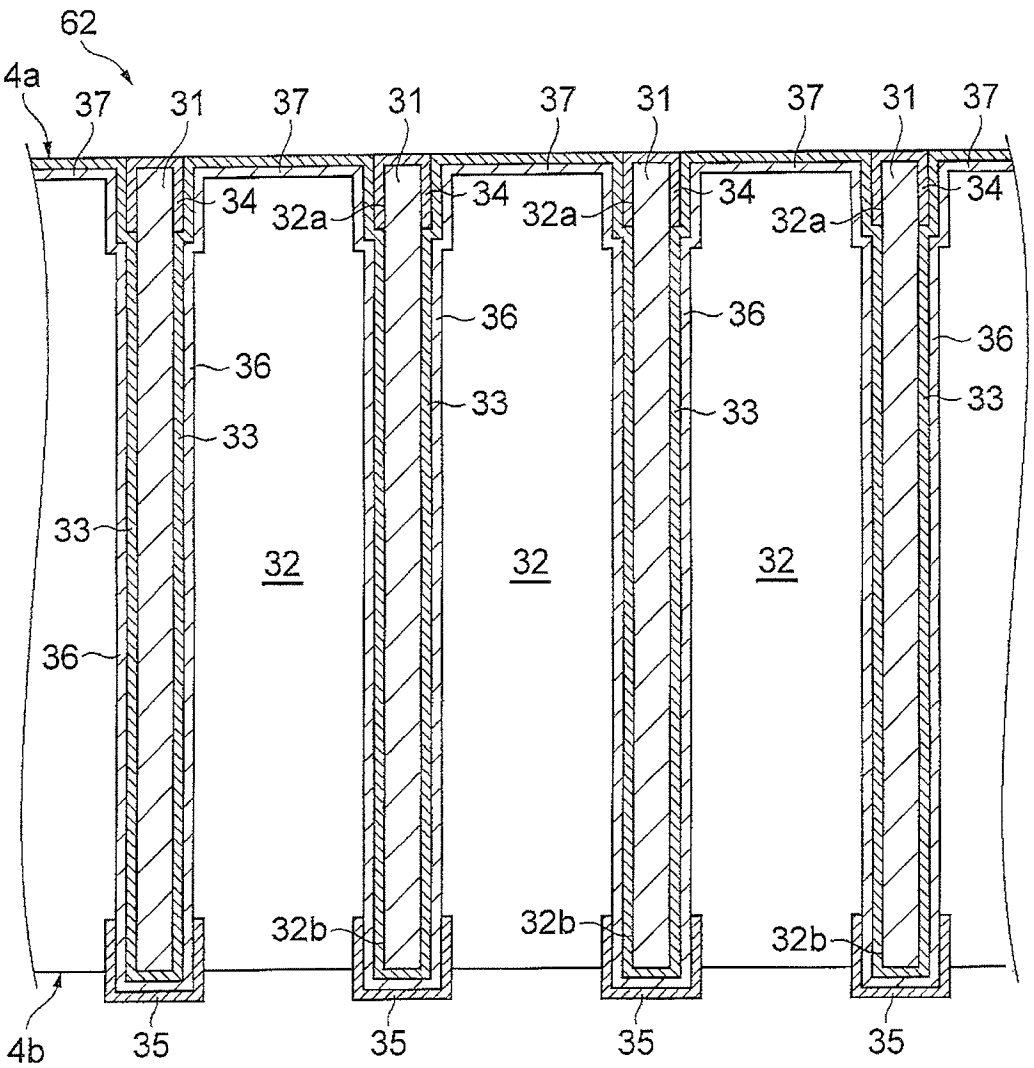
FIG. 12 is a cross-sectional view showing a film configuration of a micro-channel plate according to still another modification example.

Furthermore, the above embodiment is configured to form the electron emission film 36 and the ion barrier film 37 after the output electrode 35 is preliminarily formed on the substrate 31, but the formation of the output electrode 35 may be carried out after formation of the resistive film 33, the electron emission film 36, and the ion barrier film 37. In this case, the output electrode 35 is formed on the electron emission film 36 at the end on the output surface 4*b* side in the channels 32, as in a micro-channel plate 62 shown in FIG. 12. In this case, emission angles of secondary electrons from the electron emission film 36 are limited, which can enhance the resolution of the image intensifier 1.

The below will describe an effect verification test of the present invention.

This effect verification test is to prepare a plurality of samples of the image intensifier equipped with the micro-channel plate wherein the electron resistive film and the ion barrier film are integrally provided for the channels by the same step (Example) and a plurality of samples of the image intensifier equipped with the micro-channel plate without the ion barrier film (Comparative Example) and to measure a relative change of output from each sample with incidence of light by electric current values of a silicon monitor.

Figure 13:
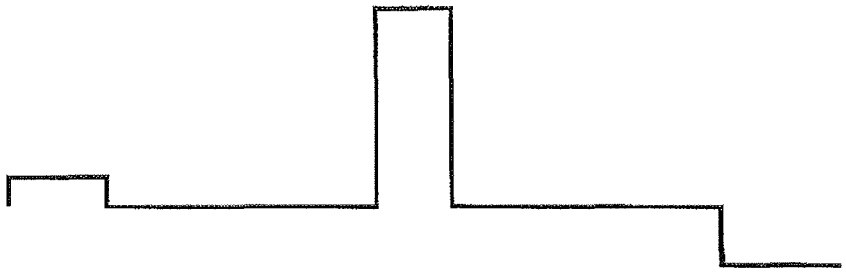
FIG. 13 is a drawing showing a condition of a light source in an effect verification test of the present invention.

A light source used in the test was one with the color temperature of 2856K. Then the relative output was measured with respect to the output of 1 at the point of time 0 while one cycle was defined as a total of twelve minutes including five seconds under the illuminance of 5400 μlx, five minutes under the illuminance of 540 μlx, three seconds under the illuminance of 54 lx, five minutes and fifty two seconds under the illuminance of 540 μlx, and one minute in a power-off state, as shown in FIG. 13.

Figure 14:
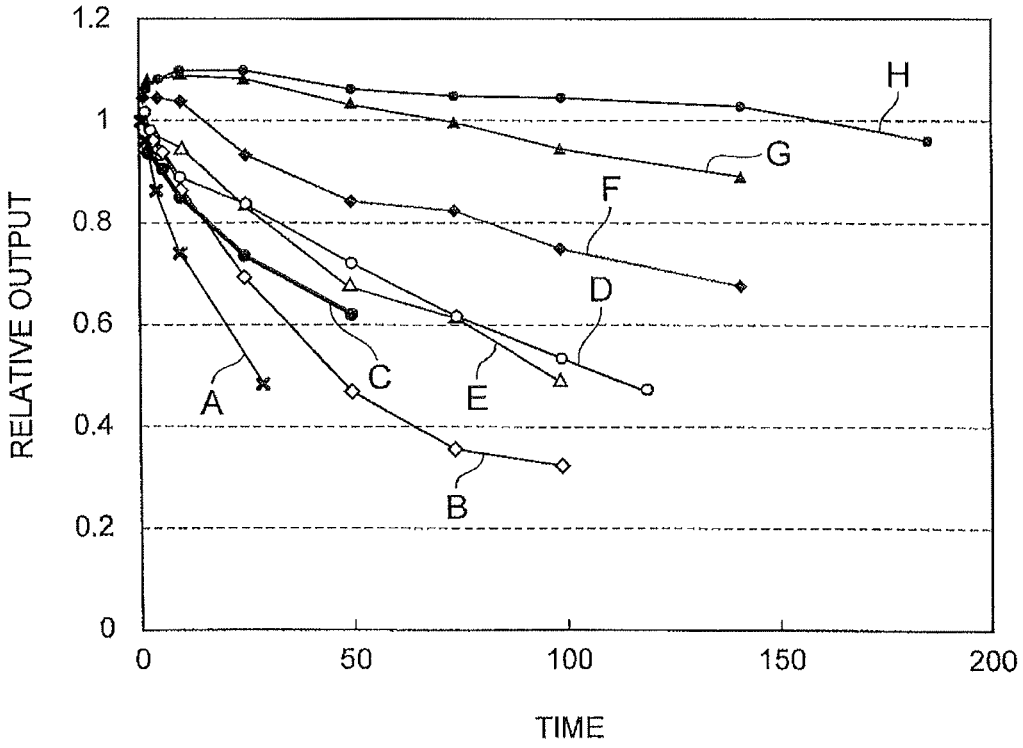
FIG. 14 is a drawing showing the results of the effect verification test of the present invention.

FIG. 14 is a drawing showing the results of the test. As shown in the same drawing, the relative output decreases with time with five samples A to E of Comparative Example; with sample A the relative output decreases to about 0.5 before a lapse of 50 hours; with sample C the relative output decreases to about 0.6 after a lapse of 50 hours. With samples B, D, and E, the relative output after a lapse of 100 hours is not more than 0.6. In contrast to it, three samples F to H of Example demonstrate slight increase of relative output after a start of measurement and thereafter the relative output is maintained at values of not less than 0.6 even after a lapse of 150 hours. Therefore, it was verified that the configuration of the present invention contributed to an improvement in life characteristics.

REFERENCE SIGNS LIST

1 image intensifier; 3 photocathode; 4, 41, 42, 52, or 62 micro-channel plate; 4*a* input surface; 4*b* output surface; 5 phosphor screen (electron incidence surface); 31 substrate; 32 channels; 32*a* openings; 33 resistive film; 34 input electrode; 35 output electrode; 36 electron emission film; 37 ion barrier film; 38 organic film; 39 metal film.

The invention claimed is:

1. A micro-channel plate comprising:

a substrate having a front surface and a back surface;

a plurality of channels penetrating from the front surface to the back surface of the substrate;

an electron emission film formed on inner wall faces of the channels; and an ion barrier film formed so as to cover openings on the front surface side of the substrate in the channels, wherein the electron emission film and the ion barrier film are integrally formed by the same film formation step.

2. The micro-channel plate according to claim 1, wherein the electron emission film and the ion barrier film are formed containing a metal oxide.

3. The micro-channel plate according to claim 1, wherein the electron emission film and the ion barrier film are deposited by an atomic layer deposition method.

4. The micro-channel plate according to claim 1, wherein a metal film formed so as to cover the front surface of the substrate is formed on the ion barrier film.

5. The micro-channel plate according to claim 1, wherein a resistive film is formed inside with respect to the electron emission film on the inner wall faces of the channels.

6. The micro-channel plate according to claim 5, wherein the resistive film is integrally formed by the same film formation step as the electron emission film and the ion barrier film are.

7. The micro-channel plate according to claim 1, wherein an input electrode is formed at an end on the front surface side of the substrate in the channels and wherein an output electrode is formed at an end on the back surface side of the substrate in the channels.

8. The micro-channel plate according to claim 7, wherein the output electrode is formed outside with respect to the electron emission film.

9. An image intensifier comprising:

a photocathode for converting incident light into photoelectrons;

the micro-channel plate as set forth in claim 1, for multiplying the photoelectrons emitted from the photocathode; and an electron incidence surface for receiving electrons multiplied by the micro-channel plate.

10. A method for manufacturing a micro-channel plate, comprising:

a substrate preparation step of preparing a substrate in which a plurality of channels are formed so as to penetrate from a front surface to a back surface;

an organic film formation step of forming an organic film so as to cover the front surface of the substrate;

a functional film formation step of, by use of an atomic layer deposition method, forming an electron emission film on inner wall faces of the channels and, at the same time, forming an ion barrier film covering openings on the front surface side of the substrate in the channels so as to overlap the organic film, integrally with the electron emission film; and an organic film removal step of removing the organic film from the front surface of the substrate, after formation of the electron emission film and the ion barrier film.

11. The method for manufacturing a micro-channel plate according to claim 10, further comprising: a metal film formation step of forming a metal film so as to cover a face of the ion barrier film on the far side from the substrate, after the organic film removal step.

12. The method for manufacturing a micro-channel plate according to claim 10, further comprising: a resistive film formation step of forming a resistive film on the inner wall faces of the channels, prior to the organic film formation step.

13. The method for manufacturing a micro-channel plate according to claim 10, wherein in the functional film formation step, a resistive film is formed integrally with the electron emission film and the ion barrier film, between the inner wall faces of the channels and the electron emission film.

14. The method for manufacturing a micro-channel plate according to claim 10, further comprising: an output electrode formation step of forming an output electrode at an end on the back surface side of the substrate in the channels, after the functional film formation step.

15. A method for manufacturing a micro-channel plate, comprising:

a substrate preparation step of preparing a substrate in which a plurality of channels are formed so as to penetrate from a front surface to a back surface;

an organic film formation step of forming an organic film so as to cover the front surface of the substrate;

a metal film formation step of forming a metal film so as to cover a face of the organic film on the far side from the substrate;

an organic film removal step of removing the organic film from the front surface of the substrate, after formation of the metal film; and a functional film formation step of, by use of an atomic layer deposition method, forming an electron emission film on inner wall faces of the channels and, at the same time, forming an ion barrier film covering openings on the front surface side of the substrate in the channels so as to overlap the metal film, integrally with the electron emission film, after the organic film removal step.

16. The method for manufacturing a micro-channel plate according to claim 15, further comprising: a resistive film formation step of forming a resistive film on the inner wall faces of the channels, prior to the organic film formation step.

17. The method for manufacturing a micro-channel plate according to claim 15, wherein in the functional film formation step, a resistive film is formed integrally with the electron emission film and the ion barrier film, between the inner wall faces of the channels and the electron emission film.

18. The method for manufacturing a micro-channel plate according to claim 15, further comprising: an output electrode formation step of forming an output electrode at an end on the back surface side of the substrate in the channels, after the functional film formation step.

* * * * *